US005929573A

United States Patent [19]

Louwers et al.

[11] Patent Number: 5,929,573

[45] **Date of Patent: *Jul. 27, 1999**

[54] SWITCHING DEVICE HAVING VARYING RC TIME PERIOD FOR IGNITION OF A LAMP

[75] Inventors: Johannes A. M. Louwers; Nicolaas H. M. Pol, both of Oss, Netherlands

[73] Assignee: U.S. Philips Corporation, New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/613,935

[22] Filed: Mar. 11, 1996

[30] Foreign Application Priority Data

Mar. 10, 1995 [EP] European Pat. Off. ..... 95200595

[51] Int. Cl.[6] ..... H05B 37/02

[52] U.S. Cl. ..... 315/219; 315/224; 315/DIG. 7; 315/291; 315/244

[58] Field of Search ..... 315/224, 307, 315/DIG. 4, DIG. 5, DIG. 7, 291, 244, 219

[56] References Cited

U.S. PATENT DOCUMENTS

| | | | |
|---|---|---|---|
| 3,628,086 | 12/1971 | Nuckolls | 315/244 |
| 4,525,648 | 6/1985 | De Bijl et al. | 315/224 |
| 4,684,851 | 8/1987 | Van Meurs | 315/224 |
| 4,712,045 | 12/1987 | Van Meurs | 315/224 |
| 5,381,077 | 1/1995 | McGuire | 315/307 |
| 5,404,083 | 4/1995 | Nilssen | 315/244 |
| 5,414,327 | 5/1995 | Reijnaerts | 315/DIG. 7 |

*Primary Examiner*—Michael B Shingleton
*Attorney, Agent, or Firm*—Edward Blocker

[57] ABSTRACT

The invention relates to a switching device for operating a lamp by means of a high-frequency current, which switching device comprises a DC-AC converter whose oscillation frequency is determined by a timer circuit comprising a resistor and a capacitor. In accordance with the invention, the timer circuit also comprises a chain C which includes a switching element and which is used to increase the RC period of the timer circuit during ignition of the lamp, thereby increasing the amplitude of the voltage across the lamp.

9 Claims, 2 Drawing Sheets

SWITCHING DEVICE HAVING VARYING RC TIME PERIOD FOR IGNITION OF A LAMP

BACKGROUND OF THE INVENTION

The invention relates to a switching device for operating a lamp by means of a high-frequency current, and more particularly, to a switching device for preheating and igniting a lamp, a control circuit which is coupled to a control electrode of the switching element, which control circuit comprises a secondary winding L2 of the transformer T and a timer circuit which is coupled to the secondary winding L2 and which is provided with a series arrangement of a resistive impedance R1, a capacitive element C1 and an auxiliary switching element S2, which is coupled to a junction point of resistive impedance R1 and capacitive element C1 and to a control electrode of the switching element S1.

Such a switching device is known from U.S. Pat. No. 4,525,648. The DC-AC converter in the known switching device is of the half-bridge type and the branch A comprises two switching elements which are alternately rendered conducting and non-conducting via respective secondary windings of the transformer T. Each switching element is coupled to a control circuit which comprises a timer circuit and a secondary winding of transformer T. Both timer circuits comprise a series arrangement of a resistor and a capacitor and interconnect the ends of the respective secondary windings of the transformer T. A junction point of the resistor and the capacitor of each timer circuit is connected, via a further resistor, to the control electrode of an auxiliary transistor whose collector is connected to the control electrode of one of the switching elements in branch A. If a switching element of branch A is in the conducting state, the capacitor of the timer circuit is charged via the resistor of the timer circuit by means of the voltage present between the ends of the secondary winding which is coupled to the conducting switching element. If the voltage across the capacitor is so high that the auxiliary transistor becomes conducting, then the conducting switching element of branch A is rendered non-conducting thereby. Thus, the period of conductance of both switching elements of branch A and hence the frequency of the high-frequency current are determined by the RC periods of the timer circuits. If the lamp operated by means of the switching device is not yet ignited, the current through the load branch is not attenuated, so that the voltages across the secondary windings have a relatively high amplitude. This relatively high amplitude causes the capacitors of the timer circuits to be charged more rapidly so that the switching frequency of the switching elements in branch A increases. This relatively high frequency can be increased further by providing breakdown elements across the resistors of the timer circuits, which breakdown elements become conducting only as a result of the relatively high amplitude of the voltages between the ends of the secondary windings if the lamp is not yet ignited. In the known switching device, these breakdown elements are constructed as zener diodes. In general, the switching device is so dimensioned that an increase of the frequency causes a decrease of the voltage across the lamp and of the current through the electrodes of the lamp. This means that these electrodes are pre-heated by a current which is sufficiently low not to cause damage to the electrodes, while the voltage across the lamp is low enough to preclude that the lamp ignites when its electrodes are not pre-heated. Frequently, the lamp ignites by means of the same voltage after the electrodes have been pre-heated. Dependent upon the dimensions of the switching device and of the lamp, it is sometimes impossible to ignite the lamp by means of the same voltage as that present across the lamp to pre-heat the electrodes or, if pre-heating of the electrodes does not take place, by means of the voltage present across the lamp after the switching device has been put into operation.

SUMMARY OF THE INVENTION

It is an object of the invention to provide a switching device which enables the lamp to be ignited substantially independently of the dimensions of the switching device and of the lamp operated by means of said switching device.

To this end, a switching device of the type mentioned in the opening paragraph is characterized in accordance with the invention in that the timer circuit comprises a further chain C which is used for setting the RC period of the timer circuit and which is provided with a further auxiliary switching element S3, and in that a control electrode of the further auxiliary switching element S3 is coupled to means M for controlling the conduction state of the further auxiliary switching element S3 in such a manner that the RC period of the timer circuit is longer during ignition of the lamp than during stationary lamp operation.

By means of chain C and means M, the RC period of the timer circuit is increased during the ignition phase, i.e. after pre-heating the electrodes or, if the electrodes are not pre-heated, immediately after putting the switching device into operation. This increase of the RC period of the timer circuit causes a decrease of the frequency of the high-frequency current flowing in the load branch. This decrease of the frequency leads to an increase of the amplitude of the voltage across the lamp, so that the lamp can ignite.

The chain C may comprise a series arrangement of the further auxiliary switching element S3 and a further resistive impedance R2 and shunts the resistive impedance R1. An increase of the RC period of the timer circuit during the ignition of the lamp is achieved in such an embodiment of the chain C in that the means M render the further auxiliary switching element S3 unconducting in the ignition phase. In every other lamp operation phase, the further auxiliary switching element S3 remains conducting. Said chain C can alternatively be constructed as a series arrangement of the further auxiliary switching element S3 and a further capacitive element C2, the latter element being shunted by chain C. In this case, an increase of the RC period of the timer circuit during ignition of the lamp is achieved in that the means M render the further auxiliary switching element S3 conducting in the ignition phase. In every other lamp operation phase, the further auxiliary switching element S3 remains non-conducting. In either case, the chain C is formed in a simple and reliable manner.

It proved to be advantageous to construct the means M in such a manner that they comprise a chain D which connects the control electrode of the further auxiliary switching element S3 to a point of the load branch B. Means M formed in said simple manner were found to operate reliably.

Usually, it is desirable to pre-heat the electrodes of the lamp before the lamp ignites. During this pre-heating process, it is necessary to maintain the amplitude of the voltage across the lamp at a level which is so low that the lamp does not ignite. The electrodes can be pre-heated by providing the switching device with a pre-heating circuit including a further timer circuit which serves to limit the amplitude of the voltage across the lamp during a predetermined time interval.

Satisfactory results were achieved with a switching device in accordance with the invention in which the DC-AC converter is a bridge circuit. In the case of a half bridge, the DC-AC converter comprises two switching elements. The control electrode of each of these switching elements is coupled to a control circuit of its own. Each one of these control circuits comprises a timer circuit. It has been found that only one of the timer circuits need be provided with a chain C, which is coupled to means M, to obtain a substantial increase of the ignition voltage.

A relatively simple construction of a switching device in accordance with the invention can be achieved by integrating the transformer T and the inductive means L into one physical component.

These and other aspects of the invention will be apparent from and elucidated with reference to the embodiments described hereinafter.

BRIEF DESCRIPTION OF THE DRAWINGS

In the drawings:

FIG. 1 shows an exemplary embodiment of a switchng device in accordance with the invention, in which reference numeral 15 denotes a low-pressure mercury discharge lamp comprising pre-heatable electrodes. Apart from terminals 1 and 2, diode bridge 3 and capacitor 10, all components of the switching device together form a DC-AC converter. Branch A is formed by switching elements S1 and S1', diodes 50 and 50' and terminals K1 and K2. Load branch B is formed by transformer T, coil L, capacitors 17 and 14, and holders K3 and K4 for accommodating a lamp. A first control circuit is formed by secondary winding L2, resistors 36' 37', 41', 61, 62, 69, 70 R1 and R2, capacitors 63, 38' and C1, diodes 34' and 71, zener diode 35', switching elements S2, S3, S4 and breakdown element 64. Chain C is formed by resistor 69, resistor R2 and switching element S3. Switching element S2 is, in this exemplary embodiment, an auxiliary switching element, and switching element S3 is a further auxiliary switching element. Resistor R1, capacitor C1 and chain C together form a first timer circuit. The means M are formed by switching element S4, resistors 66 and 70 and diode 67. Resistors 61 and 62, capacitors 38' and 63, breakdown element 64 and diode 71 together form a pre-heating circuit which comprises a further timer circuit which serves to limit the amplitude of the voltage across the lamp during a predetermined time interval. A second timer circuit is formed by secondary winding L3, resistors 36, 37, 41 and R1', capacitors 38 and C1', switching element S2', diode 34 and zener diode 35. A second control circuit is formed by resistor R1' and capacitor C1'. Switching element S2' forms an auxiliary switching element.

Figure 1:
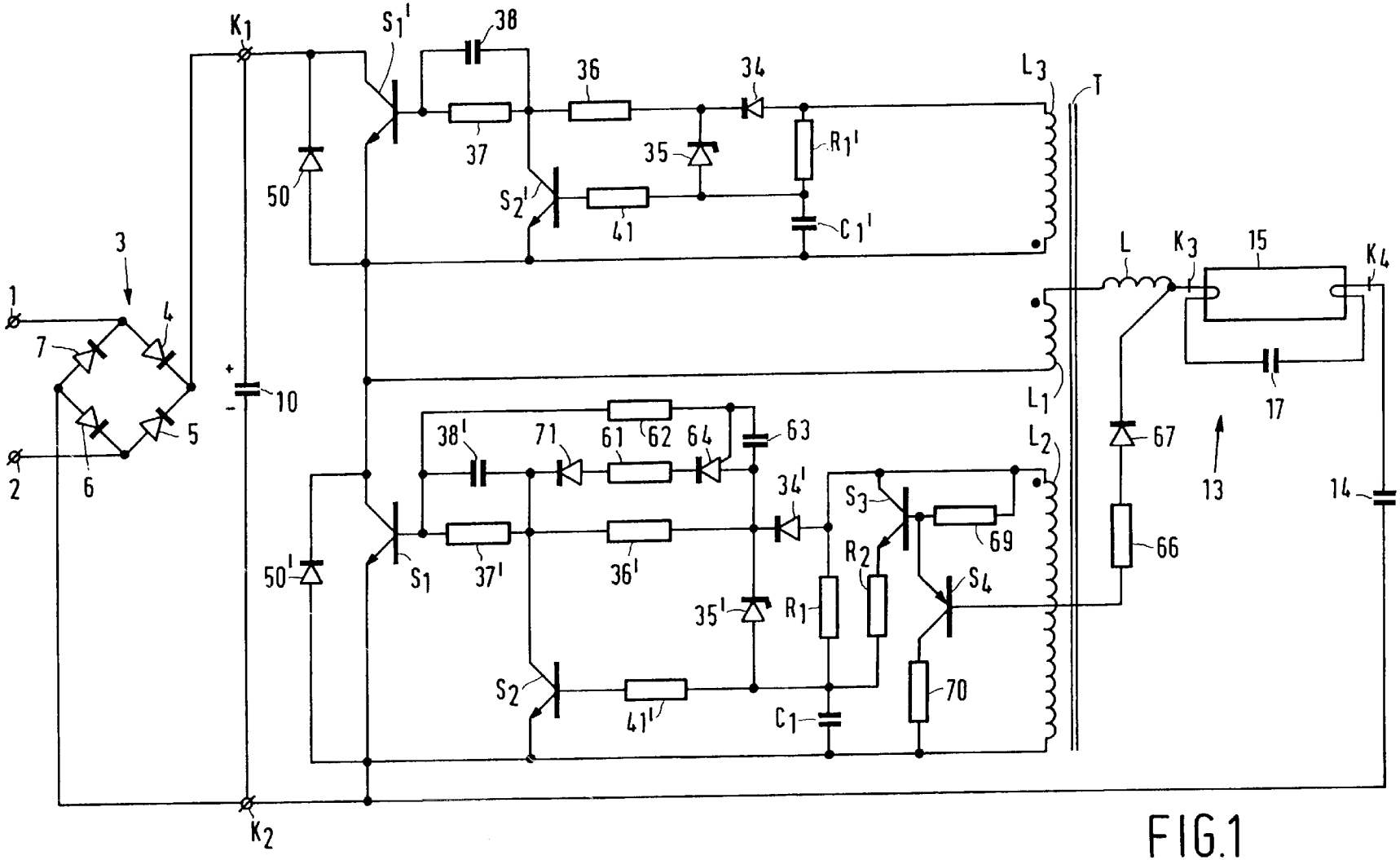
FIG. 1 schematically shows an exemplary embodiment of a switching device in accordance with the invention, to which a lamp is connected, and FIG. 2 schematically shows a further exemplary embodiment of a switching device in accordance with the invention, to which a lamp is connected.

Reference numerals 1 and 2 are terminals which are to be connected to an alternating-current source. Reference numeral 3 represents a diode bridge formed by diodes 4, 5, 6 and 7. Respective input terminals of diode bridge 3 are connected to terminals 1 and 2. Respective output terminals of diode bridge 3 are connected to terminals K1 and K2. Capacitor 10 interconnects terminals K1 and K2. Capacitor 10 is shunted by a series arrangement of switching element S1 and switching element S1'. Switching element S1' is shunted by diode 50, in such a manner that an anode of diode 50 is connected to a junction point of switching element S1 and switching element S1', and that a cathode of diode 50 is connected to terminal K1. Switching element S1 is shunted by diode 50', in such a manner that an anode of diode 50' is connected to terminal K2 and a cathode of diode 50' is connected to the junction point of switching element S1 and switching element S1'. Switching element S1 is shunted by a series arrangement of primary winding L1, coil L, holder K3, lamp 15, holder K4 and capacitor 14. The terminals of the electrodes of the lamp 15 facing away from the holders K3 and K4 are interconnected by means of capacitor 17. Terminal K2 is connected to a control electrode of switching element S1 by means of a series arrangement of secondary winding L2, diode 34', resistor 36' and resistor 37'. A junction point of resistors 36' and 37' is connected to terminal K2 by auxiliary switching element S2. A control electrode of auxiliary switching element S2 is connected to a first terminal of resistor 41'. A further terminal of resistor 41' is connected to an anode of zener diode 35' and to a first terminal of resistor R1 and to a first side of capacitor C1. A cathode of zener diode 35' is connected to a junction point of resistor 36' and diode 34'. A further terminal of resistor R1 is connected to an anode of diode 34'. A further side of capacitor C1 is connected to terminal K2. Resistor R1 is shunted by a series arrangement of a further auxiliary switching element S3 and resistor R2. A control electrode of said further auxiliary switching element S3 is connected to the anode of diode 34' via resistor 69. The control electrode of the further auxiliary switching element S3 is also connected to terminal K2 via a series arrangement of switching element S4 and resistor 70. A control electrode of switching element S4 is connected to a junction point of coil L and holder K3 by means of a series arrangement of resistor 66 and diode 67. Resistor 37' is shunted by capacitor 38'. Resistor 36' is shunted by a series arrangement of breakdown element 64, resistor 61 and diode 71. The control electrode of switching element S1 is connected to the junction point of resistor 36' and diode 34' via a series arrangement of resistor 62 and capacitor 63. A junction point of resistor 62 and capacitor 63 is connected to a control electrode of breakdown element 64. The junction point of switching element S1 and switching element S1' is connected to a control electrode of switching element S1' by means of a series arrangement of secondary winding L3, diode 34, resistor 36 and resistor 37. Resistor 37 is shunted by capacitor 38. Auxiliary switching element S2' connects a junction point of resistor 36 and resistor 37 to the junction point of switching element S1 and switching element S1'. A control electrode of auxiliary switching element S2' is connected to a first terminal of resistor 41. A further terminal of resistor 41 is connected to an anode of zener diode 35, to a first terminal of resistor R1' and to a first side of capacitor C1'. A cathode of zener diode 35 is connected to a junction point of resistor 36 and diode 34. A further terminal of resistor R1' is connected to an anode of diode 34. A further side of capacitor C1 is connected to the junction point of switching element S1 and switching element S1'.

The switching device shown in FIG. 1 operates as follows.

If terminals 1 and 2 are connected to an alternating-current source, a direct voltage is present across capacitor 10, and oscillation of the DC-AC converter is initiated by means which are not shown in FIG. 1. The switching elements S1 and S1' are alternately rendered conducting and non-conducting, so that a high-frequency current of a first frequency f1 flows in the load branch B. Ignition of the lamp does not take place immediately after the circuit has been put into operation, so that the amplitude of the high-frequency current is relatively high. As a result, also the amplitudes of the voltages across secondary winding L2 and secondary winding L3 are relatively high, so that the capacitors C1 and C1' are charged not only via resistor R1 and resistor R1', respectively, but also via zener diode 35' and zener diode 35, respectively. If switching element S1 is conducting, capacitor C1 is charged also via the further auxiliary switching element S3 and resistor R2. A voltage increase across capacitor C1 of such a magnitude that auxiliary switching element S2 becomes conducting causes switching element S1 to be rendered non-conducting via resistor 37' and capacitor 38'. Subsequently, switching element S1' becomes conducting and, after capacitor C1' has been charged to a voltage level at which the auxiliary switching element S2' becomes conducting, capacitor 38 is rendered non-conducting via resistor 37. Thus, the period of conductance of the switching elements S1 and S1', and hence the frequency of the high-frequency current in the load branch, are determined by the timer circuits which form part of the control circuits. The switching device is given such dimensions that at a frequency f1 the electrodes of the lamp are pre-heated. However, at a frequency f1, the amplitude of the voltage across the lamp is so low that even after warmup of the electrodes, the lamp does not ignite. During the period of conductance of switching element S1, also capacitor 63 is charged. When the voltage across capacitor 63 is high enough, breakdown element 64 becomes conducting so that resistor 61 is arranged parallel to resistor 36'. The effective resistance of the parallel arrangement of resistor 36' and resistor 61 is considerably less than the resistance of resistor 36'. As a result, the current through the control electrode of the switching element S1 increases while the current with which capacitor C1 is charged decreases. Consequently, the frequency of the high-frequency current in the load branch adjusts itself at a frequency which is lower than the frequency f1. Due to this reduction in frequency, the amplitude of the current in the load branch increases and auxiliary switching element S4 is rendered conducting and, as a result, auxiliary switching element S3 is rendered non-conducting. The fact that the auxiliary switching element S3 becomes non-conducting leads to an increase of the RC period of the timer circuit, which leads to a further reduction of the operating frequency. This further reduction of the operating frequency causes an increase of the amplitude of the high-frequency current in the load branch and of the amplitude of the voltage across the lamp, so that the lamp can ignite. After ignition of the lamp, the amplitude of the high-frequency current in the load branch decreases. As a result, the amplitudes of the high-frequency voltages across secondary windings decrease. Consequently, the capacitors C1 and C1' are no longer charged by zener diode 35' and zener diode 35, respectively, and the auxiliary switching element S3 is permanently conducting. As a result, the operating frequency of the switching device adopts the value which corresponds to stationary lamp operation, which is or higher than the frequency at which the lamp is ignited.

Figure 2:
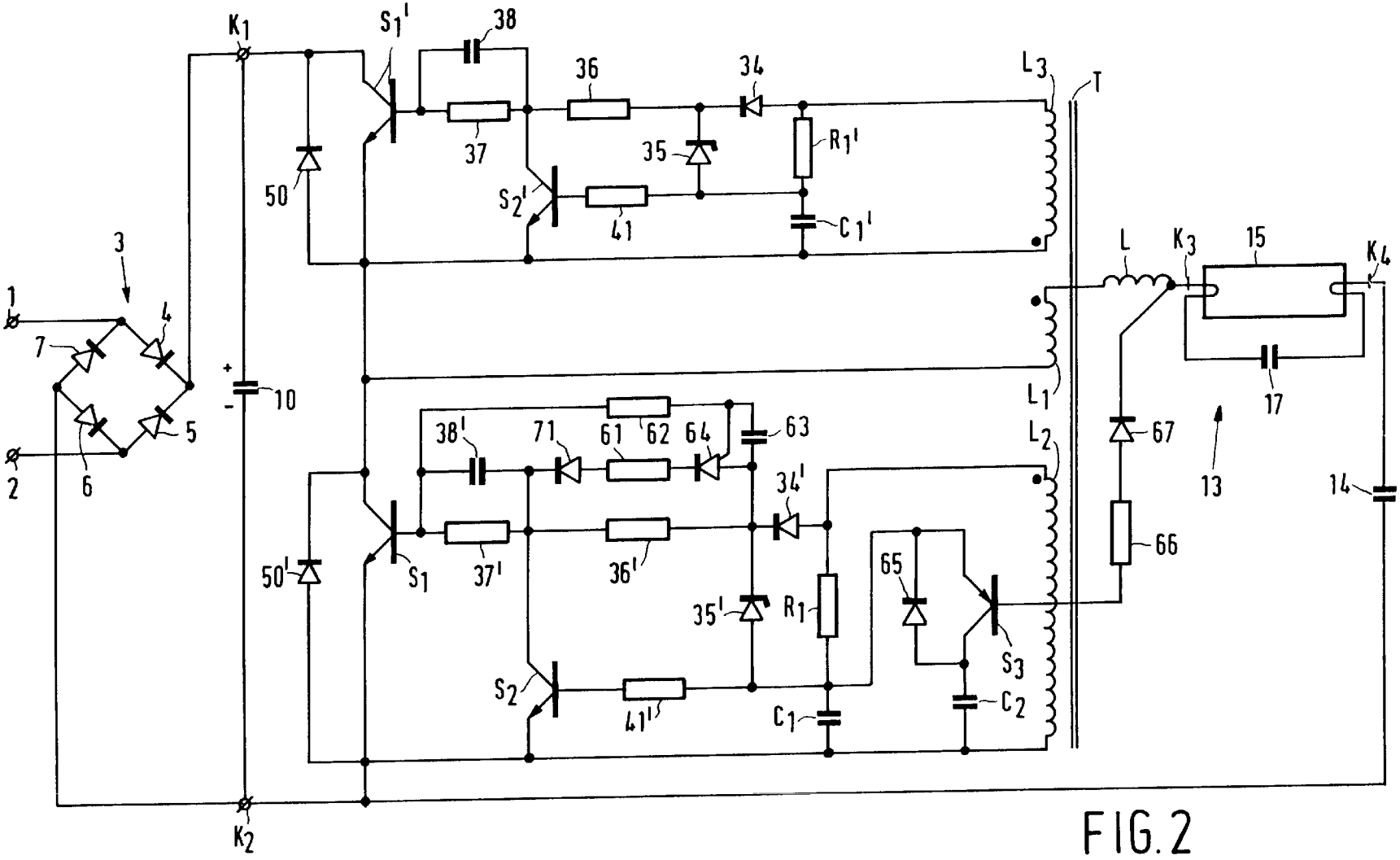

Apart from chain C and means M, the exemplary embodiment shown in FIG. 2 largely corresponds to the exemplary embodiment shown in FIG. 1. In the exemplary embodiment of FIG. 2, chain C is formed by diode 65, auxiliary switching element S3 and capacitor C2. Means M are formed by resistor 66 and diode 67. A series arrangement of the further auxiliary switching element and capacitor C2 shunts capacitor C1. A junction point of the further auxiliary switching element and capacitor C2 is connected to an anode of diode 65. A cathode of diode D5 is connected to a junction point of resistor R1 and capacitor C1. A control electrode of the further auxiliary switching element S3 is connected to a junction point of coil L and holder K3 by means of a series arrangement of resistor 66 and diode 67.

The operation of the switching device shown in FIG. 2 largely corresponds to the operation of the switching device shown in FIG. 1. Analogous to the above-described switching device shown in FIG. 1, breakdown element 64 becomes conducting after the electrodes of the lamp have been pre-heated, so that the frequency of the high-frequency current in the load branch decreases. The resultant increase of the amplitude of the high-frequency current causes the auxiliary switching element to become conducting, so that capacitor C1 and capacitor C2 are arranged in parallel and the RC period of the timer circuit increases. This increase of the RC period causes a further decrease of the frequency of the high-frequency current in the load branch and, consequently, a further increase of the amplitude of the voltage across the lamp, allowing the lamp to ignite. After ignition of the lamp, the amplitude of the high-frequency current in the load branch decreases, causing the further auxiliary switching element S3 to become non-conducting.

It will thus be seen that the objects set forth above and those made apparent from the preceding description are efficiently attained, and since certain changes can be made in the above construction set forth without departing from the spirit and scope of the invention, it is intended that all matter contained in the above description and shown in the accompanying drawings shall be interpreted as illustrative and not in a limiting sense.

It is also to be understood that the following claims are intended to cover all the generic and specific features of the invention herein described and all statements of the scope of the invention, which as a matter of language, might be said to fall therebetween.

We claim:

1. A switching device for operating a lamp at a high-frequency current and having a DC-AC converter, comprising:

a first branch including a first switching element and terminals which are to be connected to the poles of a direct-current source, a load branch which shunts the first switching element and which includes a primary winding of a transformer, a control circuit coupled to a control electrode of the first switching element and including a secondary winding of the transformer and a timer circuit coupled to the secondary winding and having an arrangement of a resistive impedance coupled to a capacitive element which is coupled to a second switching element wherein a junction point joining the resistive impedance and capacitive element together is coupled to a control electrode of the first switching element, characterized in that the timer circuit further includes setting means having a third switching element for increasing an RC period of the timer circuit only during an ignition phase of the lamp, a control electrode of the third switching element being coupled to driving means responsive to entry into the ignition phase for automatically controlling the conduction state of the third switching element in such a manner that the RC period of the timer circuit is longer during the ignition phase of the lamp than during stationary lamp operation.

2. The switching device as claimed in claim 1, wherein the setting means shunts the resistive impedance and includes a series arrangement of the third switching element and a further resistive impedance.

3. The switching device as claimed in claim 1, wherein the setting means shunts the capacitive means and includes a series arrangement of the third switching element and a further capacitive element.

4. The switching device as claimed in claim 1, wherein the driving means connects the control electrode of the third switching element to the load branch.

5. The switching device as claimed in claim 1, wherein the DC-AC converter is a bridge circuit.

6. A switching device for operating a lamp at a high-frequency current and having a DC-AC converter, comprising:

a first branch including a first switching element and terminals which are to be connected to the poles of a direct-current source, a load branch which shunts the first switching element and which includes a primary winding of a transformer, a control circuit coupled to a control electrode of the first switching element and including a secondary winding of the transformer and a timer circuit coupled to the secondary winding and having an arrangement of a resistive impedance coupled to a capacitive element which is coupled to a second switching element wherein a junction point joining the resistive impedance and capacitive element together is coupled to a control electrode of the first switching element, characterized in that the control circuit further includes a pre-heating circuit for limiting the amplitude of the voltage across the lamp during a predetermined pre-heating time interval, and characterized in that the timer circuit further includes setting means having a third switching element for increasing an RC period of the timer circuit only during an ignition phase of the lamp following the pre-heating time interval, a control electrode of the third switching element being coupled to driving means responsive to expiration of the pre-heating time interval for automatically controlling the conduction state of the third switching element in such a manner that the RC period of the timer circuit is longer during the ignition phase of the lamp than during the pre-heating time interval.

7. The switching device as claimed in claim 2, wherein the driving means connects the control electrode of the third switching element to the load branch.

8. The switching device as claimed in claim 3, wherein the driving means connects the control electrode of the third switching element to the load branch.

9. A switching device as claimed in claim 6, wherein the RC period of the timer circuit is longer during the ignition phase of the lamp than during the stationary lamp operation.

* * * * *